United States Patent [19]

Wilson

[11] Patent Number: 4,959,635

[45] Date of Patent: Sep. 25, 1990

[54] LOCK

[75] Inventor: Edwin P. Wilson, Allison Park, Pa.

[73] Assignee: Minatronics Corporation, Pittsburgh, Pa.

[21] Appl. No.: 352,757

[22] Filed: May 16, 1989

[51] Int. Cl.[5] ..... G08B 13/14

[52] U.S. Cl. ..... 340/568; 70/58

[58] Field of Search ..... 340/542, 555, 568; 70/58, 18; 250/227; 350/96.23

[56] References Cited

U.S. PATENT DOCUMENTS

| | | | |
|---|---|---|---|
| 3,714,644 | 1/1973 | Hellstrom | 340/542 X |
| 4,057,983 | 11/1977 | Morgan | 70/58 X |
| 4,296,615 | 10/1981 | Zoor | 70/58 X |
| 4,546,345 | 10/1985 | Naito | 340/542 |
| 4,760,382 | 7/1988 | Faulkner | 340/568 X |

*Primary Examiner*—Joseph A. Orsino

*Assistant Examiner*—Thomas J. Mullen, Jr.

*Attorney, Agent, or Firm*—Cohen & Grigsby

[57] ABSTRACT

A lock for preventing the removal of an object having a first portion with a smaller cross-sectional area than the cross-sectional area of a second portion or the cross-sectional area of a third portion between which the first portion is disposed comprised of a housing having an opening and a removable member. The removable member is disposed in the opening such that when the member is removed at least the second portion or the third portion of the object can fit through the opening in the housing, but when the member is disposed in the opening, only the first portion of the object can fit therethrough. The lock is also comprised of a cable which extends through the housing. The lock can additionally include a device for determining when the cable no longer extends through the housing. The determining device is in communication with the cable.

8 Claims, 1 Drawing Sheet

LOCK

FIELD OF THE INVENTION

The present invention relates to a lock. More specifically, the present invention relates to a lock for preventing the removal of an object having a first portion with a smaller cross-sectional area than the cross-sectional area of a second portion or the cross-sectional area of a third portion between which the first portion is disposed.

BACKGROUND OF THE INVENTION

The proliferation of computer equipment has spawned numerable appurtennances, some of which, although small, are quite costly. Locks are needed not only to prevent the unauthorized removal of the computers but also the unauthorized removal of appurtenances such as keyboards and mouses. The present invention is a simple and inexpensive apparatus which can alert a user that an object, whether it be related to computer or otherwise, is being removed without proper authority.

SUMMARY OF THE INVENTION

The present invention pertains to a lock for preventing the removal of an object having a first portion with a smaller cross-sectional area than the cross-sectional area of a second portion or the cross-sectional area of a third portion between which the first portion is disposed. The lock is comprised of a housing having an opening and a removable member. The removable member is disposed in the opening such that when the member is removed at least the second portion or the third portion of the object can fit through the opening in the housing, but when the member is disposed in the opening, only the first portion of the object can fit therethrough. The lock is also comprised of a cable which extends through the housing. The lock can additionally include means for determining when the cable no longer extends through the housing. The determining means is in communication with the cable.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1:
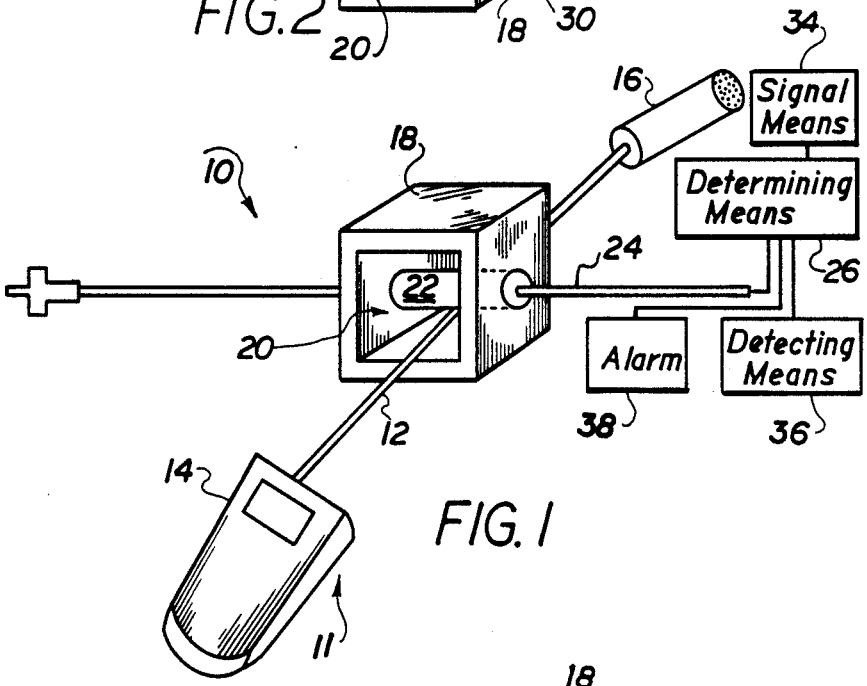
FIG. 1 is a perspective view of the lock in a first application with respect to an object.

Referring now to the drawings wherein like reference numerals refer to similar or identical parts throughout the several views, and more specifically to FIG. 1 thereof, there is shown a perspective view of a lock 10 for preventing the removal of an object having a first portion 12 with a smaller cross-sectional area than the cross-sectional area of a second portion 14 and the cross-sectional area of a third portion 16 between which the first portion 12 is disposed. The lock 10 is comprised of a housing 18 having an opening 20 and removable member 22. The removable member 22 is disposed in the opening 20 such that when the member 22 is removed, at least the second portion 14 or the third portion 16 of the object 11 can fit through the opening 20 in the housing 18, but when the member 22 is disposed in the opening 20, only the first portion 12 of the object 11 can fit therethrough. The lock is also comprised of a cable 24 which extends through the housing 18. The lock 10 can also include means 26 for determining when the cable 24 no longer extends through the housing 18. The determining means 26 is in communication with the cable 24.

Figure 2:
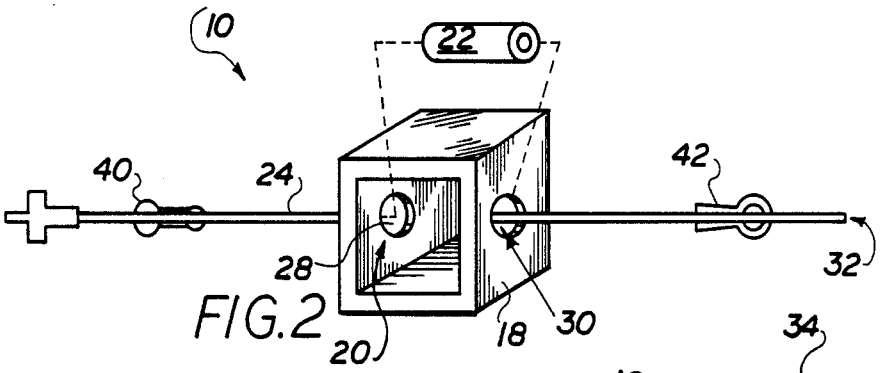
FIG. 2 is an exploded perspective view of a lock.

Preferably, the member 22 is hollow and the cable 24 extends through the housing 18 via the hollow member 22. The housing preferably has a first hole 28 and a second hole 30 which communicates with the opening 20 as shown in FIG. 2 which is an exploded view of the lock 10. The hollow member 22 is in alignment with the first hole 28 and the second hole 30 such that the cable 24 extends through the housing 18 via the first hole 28, the member 22 and the second hole 30.

As a strain relief, the member 22 is removably attached to the housing 18 with a first hollow plug 40 and a second hollow plug 42 which removably extends through the first hole 28 and second hole 30, respectively, and into the hollow member 22 such that the hollow member 22 is held in place in the housing 18. Preferably, the hollow member 22 is a cylinder.

The cable 24 preferably includes an optical fiber 32. The determining means 26 preferably includes means 34 for producing an optical signal in the optical fiber 32 and means 36 for detecting whether the optical signal passes through the optical fiber 32. The determining means 26 also preferably includes an alarm 38 that is triggered when the optical signal does not pass through the optical fiber 32. The length of member 22 is such that attempted removal of member 21 from housing 18 causes cable 24 to be cut thereby causing an alarm 38 due to the disruption of the optical signal.

In the operation of the invention, the second portion 14 or the third portion 16, whichever is small enough to fit through opening 20 of housing 18 without the member 22 disposed therein is inserted through opening 20. For instance, if the object 11 is a mouse for a computer (not shown), third portion 16 is the coupler that connects to the computer and is small enough to fit through opening 20 without member 22 therein, but if member 22 is disposed in the opening 20, then the coupler cannot fit through the opening 20; so the mouse is held by the lock 10. Once the second portion 14 or the third portion 16 is through the opening 20 and the first portion 12 of the object 11 extends through the housing 18 by way of the opening 20, the hollow member 22 is placed into the opening 20 of housing 18 such that it is aligned with first hole 28 and second hole 30. The first plug 40 is then inserted through first hole 28 into the member 22 and second plug 42 is inserted through second hole 30 into member 22 in order for member 22 to be removably fixed in the opening 20 of housing 18. Cable 28, having optical fiber 32, is then extended through the opening 20 of housing 18 by being passed through first hole 28, hollow member 22 and then the second hole 30. The cable 24 is then connected to the determining means such that an optical signal is transmitted by the signal means 34.

As long as the optical fiber 32 of the cable 24 is intact and allows optical signal to pass therethrough and be received by the detecting means 36, the alarm 38 does not sound. However, in the event that, for instance, cable 24 with optical fiber 34 is cut so that member 22 can be removed in order for object 11 to be taken, the optical signal is then prevented from reaching the detecting means 36 since the path thereto no longer exists, and alarm 38 sounds.

Figure 3:
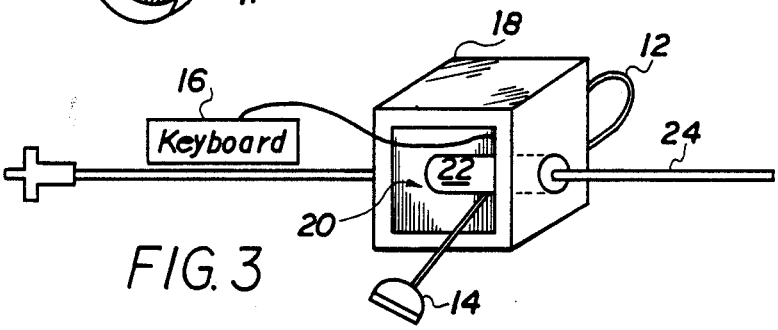
FIG. 3 is a perspective view of a lock in a second application with respect to an object.

The lock 10 can also be used with an object 11 such as a keyboard as shown in FIG. 3 which is plugged into a computer. In this application, instead of the first portion 12 of the object 11 extending straight through the opening 20 of housing 18 as shown in FIG. 1, the first portion 12 loops around the member 22 in opening 20. The lock 10, once again, prevents unauthorized removal of the object 11.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A lock for preventing the removal of an object having a first portion with a smaller cross-sectional area than the cross-sectional area of a second portion or the cross-sectional area of a third portion between which the first portion is disposed comprising:

a housing having an opening and a removable member disposed in the opening such that when the member is removed at least the second portion or the third portion of the object can fit through the opening in the housing, but when the member is disposed in the opening, only the first portion of the object can fit therethrough; and a cable which extends through the housing.

2. A lock as described in claim 1 including means for determining when the cable no longer extends through the housing, said determining means being in communication with said cable.

3. A lock for preventing the removal of an object having a first portion with a smaller cross-sectional area than the cross-sectional area of a second portion or the cross-sectional area of a third portion between which the first portion is disposed comprising:

a housing having an opening and a removable hollow member disposed in the opening which that when the member is removed at least the second portion or the third portion of the object can fit through the opening of the housing, but when the member is disposed in the opening, only the first portion of the object can fit therethrough;

a cable which extends through the housing via the hollow member, and means for determining when the cable no longer extends through the housing, said determining means being in communication with said cable.

4. A lock as described in claim 3 wherein the housing has a first hole and a second hole which communicate with the opening, and wherein said hollow member is in alignment with said first hole and said second hole such that the cable extends through the housing via the first hole, the member and the second hole.

5. A lock as described in claim 4 wherein the cable includes an optical fiber and wherein the determining means includes means for producing an optical signal in the optical fiber and means for detecting whether the optical signal passes through the optical fiber.

6. A lock as described in claim 5 wherein the determining means includes an alarm that is triggered when the optical signal does not pass through the fiber.

7. A lock as described in claim 6 wherein the member is removably attached to the housing with a first hollow plug and a second hollow plug which removably extend through the first hole and second hole, respectively, and into the hollow member such that the hollow member is held in place in the housing.

8. A lock as described in claim 7 wherein the hollow member is a cylinder.

* * * * *